US008130153B2

(12) United States Patent
Koh et al.

(10) Patent No.: US 8,130,153 B2
(45) Date of Patent: Mar. 6, 2012

(54) ELECTRONIC DEVICE AND ELECTRONIC ASSEMBLY

(75) Inventors: Boon Ping Koh, Petaling Jaya (MY); Nur Ainunnazli Aminuddin, Subang Jaya (MY); Seng Shin Lim, Kulim (MY); Sooliam Ooi, Plantation, FL (US)

(73) Assignee: Motorola Solutions, Inc., Schaumburg, IL (US)

( * ) Notice: Subject to any disclaimer, the term of this patent is extended or adjusted under 35 U.S.C. 154(b) by 694 days.

(21) Appl. No.: 12/129,815

(22) Filed: May 30, 2008

(65) Prior Publication Data

US 2009/0295647 A1 Dec. 3, 2009

(51) Int. Cl.
*H01Q 1/24* (2006.01)

(52) U.S. Cl. ..... 343/702; 343/846; 343/841

(58) Field of Classification Search ..... 343/702, 343/895, 901, 846, 841
See application file for complete search history.

(56) References Cited

U.S. PATENT DOCUMENTS

| | | | | |
|---|---|---|---|---|
| 5,796,578 | A | 8/1998 | Jones | |
| 6,215,454 | B1 * | 4/2001 | Tran | 343/841 |
| 6,392,603 | B1 * | 5/2002 | Kurz et al. | 343/702 |
| 7,102,577 | B2 | 9/2006 | Richard | |
| 2004/0085248 | A1 * | 5/2004 | Onaka et al. | 343/702 |
| 2004/0203510 | A1 * | 10/2004 | Claxton et al. | 455/90.3 |
| 2006/0089682 | A1 | 4/2006 | Kronich | |
| 2007/0063904 | A1 * | 3/2007 | Chen et al. | 343/702 |
| 2008/0081657 | A1 | 4/2008 | Suzuki | |

FOREIGN PATENT DOCUMENTS

| | | | |
|---|---|---|---|
| JP | 10-084406 | A | 3/1998 |
| KR | 10-2003-0076039 | A | 9/2003 |

OTHER PUBLICATIONS

PCT Search Report Dated Dec. 24, 2009.

* cited by examiner

*Primary Examiner* — Douglas W Owens
*Assistant Examiner* — Dieu H Duong
(74) *Attorney, Agent, or Firm* — Terri Hughes Smith; Anthony P. Curtis; Daniel R. Bestor

(57) ABSTRACT

An electronic assembly and electronic device used for radio frequency communications are presented. The electronic device has a housing and an antenna feed point at least partially enclosed in the housing. There is at least one circuit board enclosed in the housing. An antenna counterpoise is coupled to the feed point. The counterpoise is enclosed in the housing and the counterpoise includes a foldable metallic patch that is folded around the circuit board such that the circuit board is sandwiched between opposite facing portions of the foldable metallic patch.

18 Claims, 4 Drawing Sheets

ELECTRONIC DEVICE AND ELECTRONIC ASSEMBLY

FIELD OF THE INVENTION

The present invention relates generally to an electronic device and electronic assembly that are associated with a radio frequency antenna. The invention is specifically useful for, but not necessarily limited to, providing an antenna counterpoise that results in a desired antenna radiation pattern that is substantially unaffected by circuit board components.

BACKGROUND OF THE INVENTION

Radio frequency communication devices, such as two-way radios or cellular telephones, are known to have circuitry to receive or transmit radio frequency signals via an antenna. The antenna is the critical element of a radio frequency communication device and antenna performance and radiation efficiency is often considered as an important attribute of such devices. A monopole antenna that extends from a housing of the radio frequency communication device is often used to obtain both good antenna performance and radiation efficiency.

One part of a monopole antenna assembly that affects the antenna performance is the counterpoise. Theoretically, a counterpoise provides a radiation pattern that is opposite that of the radiation pattern provided by the monopole antenna. Accordingly, one end of the monopole antenna is coupled to and extends away from a feed point and the counterpoise is also coupled to and extends away from the feed point in an opposite direction from the monopole antenna. The surface area (size) and positioning of the counterpoise are important antenna design considerations and historically the counterpoise for a two-way radio or cellular telephone was formed primarily by metallic conductors on their main circuit board.

In recent years there is a desire for smaller hand held communication devices and accessories that require antennas. One such accessory is a Public Safety Microphone that when in use is operatively coupled by a cable to a two-way radio typically mounted on a belt of a user. Typically, these smaller hand held communication devices and accessories inherently have a relatively small main circuit board and thus the surface area for a counterpoise that can be provided by the circuit board may be insufficient for providing good quality antenna performance.

In order to overcome the insufficient circuit board counterpoise surface area associated with relatively small main circuit boards, the counterpoise can be provided by a conductive paint coating or conductive ink coating that is sprayed onto the inside surface of a device's housing. Typically, this housing comprises two opposing housing members and the inside surface of both members has the coating sprayed or otherwise deposited thereon. Hence, the main circuit board is surrounded by the counterpoise and thus the radiation pattern of the antenna is not substantially attenuated or distorted by the components of the device.

Although conductive coatings on the inside surface of the housing provides a basis for good antenna performance, such coatings are relatively expensive due to both the cost of the paint and the cost associated with depositing the coating on the inside surfaces.

BRIEF DESCRIPTION OF THE DRAWINGS

In order that the invention may be readily understood and put into practical effect, reference now will be made to exemplary embodiments as illustrated with reference to the accompanying figures, wherein like reference numbers refer to identical or functionally similar elements throughout the separate views. The figures together with a detailed description below, are incorporated in and form part of the specification, and serve to further illustrate the embodiments and explain various principles and advantages, in accordance with the present invention, where.

Figure 1:
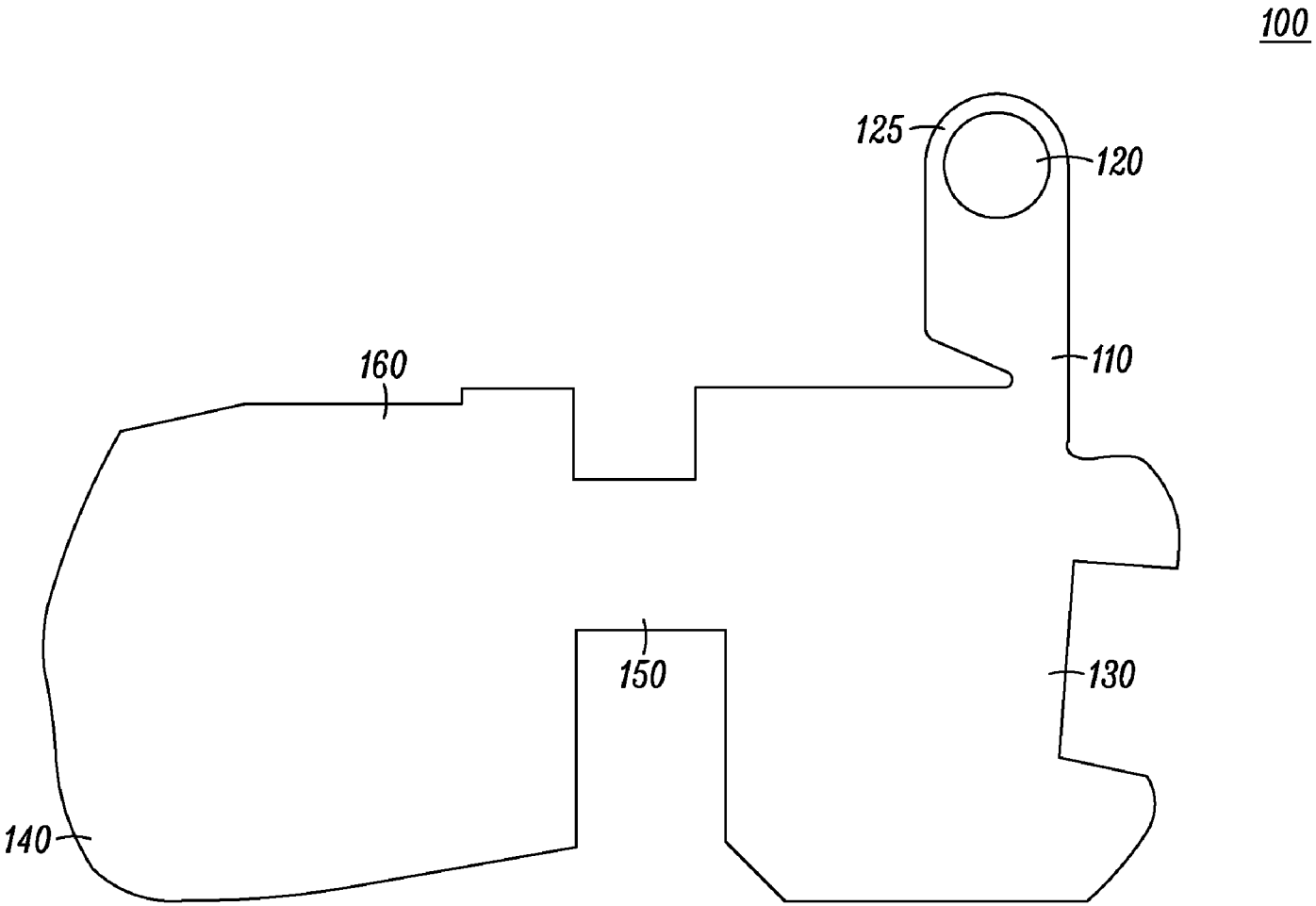
FIG. 1 is a plan view of a foldable metallic patch in an unfolded state according to an embodiment of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in device components related to an electronic device and electronic assembly. Accordingly, the device and assembly components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this disclosure, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that device components that comprises a list of elements does not include only those elements but may include other elements not expressly listed or inherent to such a device or assembly component. An element proceeded by "comprises . . . a" does not, without more constraints, preclude the existence of additional identical elements in the device or assembly that comprises the element.

According to one embodiment of the present invention there is provided an electronic assembly comprising an antenna feed point and at least one circuit board. There is an antenna counterpoise coupled to the feed point. The counterpoise includes a foldable metallic patch that is folded around the circuit board such that the circuit board is sandwiched between opposite facing portions of the foldable metallic patch.

According to another embodiment of the present invention there is provided an electronic device comprising a housing and an antenna feed point at least partially enclosed in the housing. There is at least one circuit board enclosed in the housing; an antenna counterpoise is coupled to the feed point. The counterpoise is enclosed in the housing and the counterpoise includes a foldable metallic patch that is folded around the circuit board such that the circuit board is sandwiched between opposite facing portions of the foldable metallic patch.

Referring to FIG. 1 there is illustrated a plan view of a foldable metallic patch 100 typically formed of a single copper sheet or other suitable metal sheet. The foldable metallic patch 100 is usually punched out of the copper sheet and has a connecting arm 110 with an aperture 120 disposed adjacent a free end of the connecting arm 110. The foldable metallic patch 100 has opposite facing portions 130, 140 that are linked together by a bridging portion 150 and typically of the opposite facing portions 130, 140 have similar, but not necessarily identical, surface areas. Also, as shown, the opposite facing portions 130, 140 do not necessarily need to have the same shape. The bridging portion 150 and part of the connecting arm 110 are covered in an electrical insulating material 160 such as a varnish, plastics coat or lacquer. A rim 125 around the aperture 120 is not covered by the electrical insulating material 160 as this rim 125 is required to provide an electrical connection to a feed point, therefore in this embodiment the foldable metallic patch is partially covered, on both sides, with the electrical insulating material 160.

Figure 2:
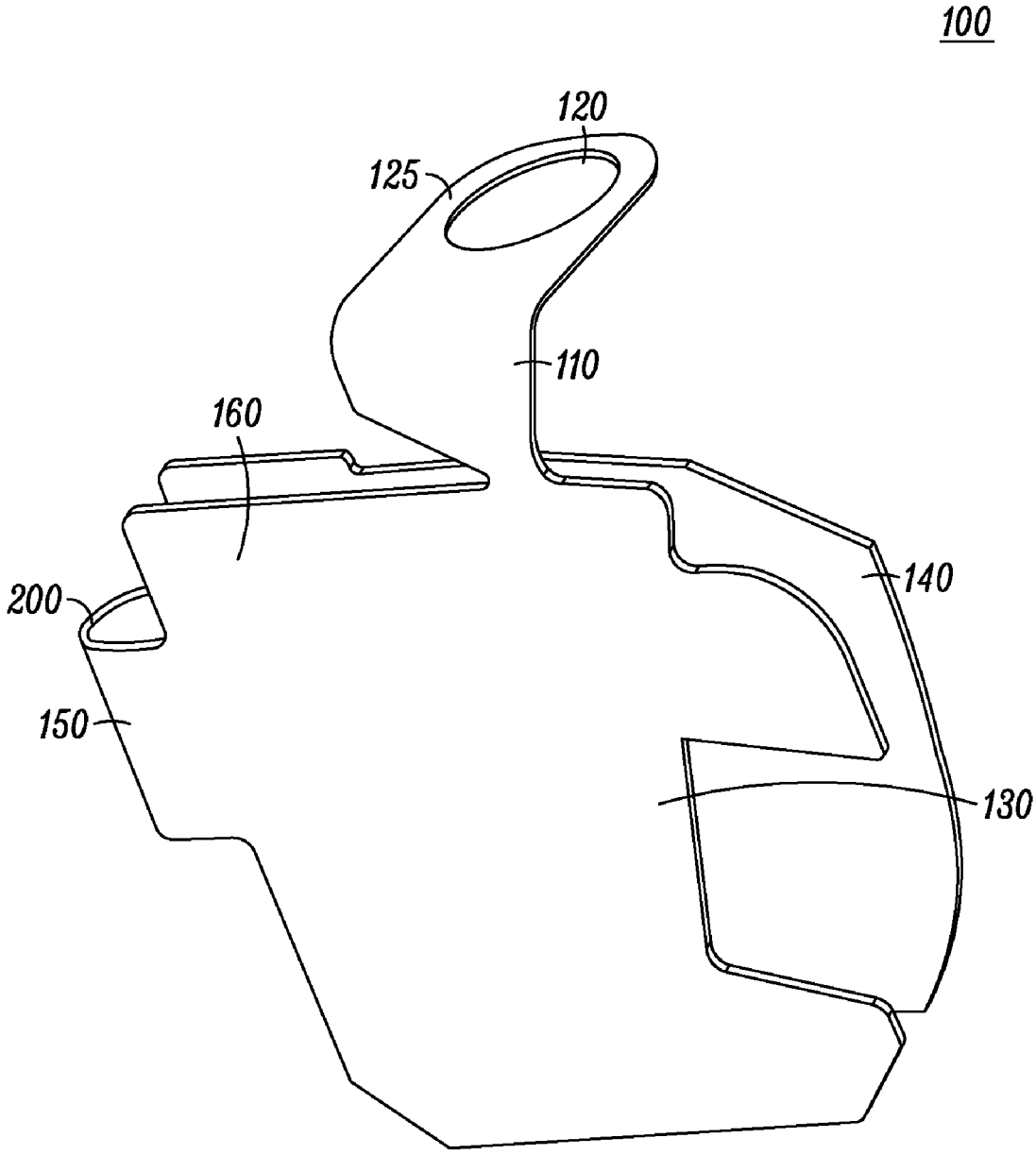
FIG. 2 is a perspective view of the foldable metallic patch of FIG. 1 when in a folded state according to an embodiment of the present disclosure.

Referring to FIG. 2, there is illustrated a perspective view of a the foldable metallic patch 100 when in a folded state, the foldable metallic patch 100 is typically formed from a sheet having a thickness of less than 0.1 mm and therefore it has malleable or pliable properties. In this embodiment, the folded state is formed by bending the foldable metallic patch 100 at the bridging portion 150 and thus, when folded, the opposite facing portions 130, 140 face each other and there is a bend 200 of approximately 180 degrees in the bridging portion 150.

Figure 3:
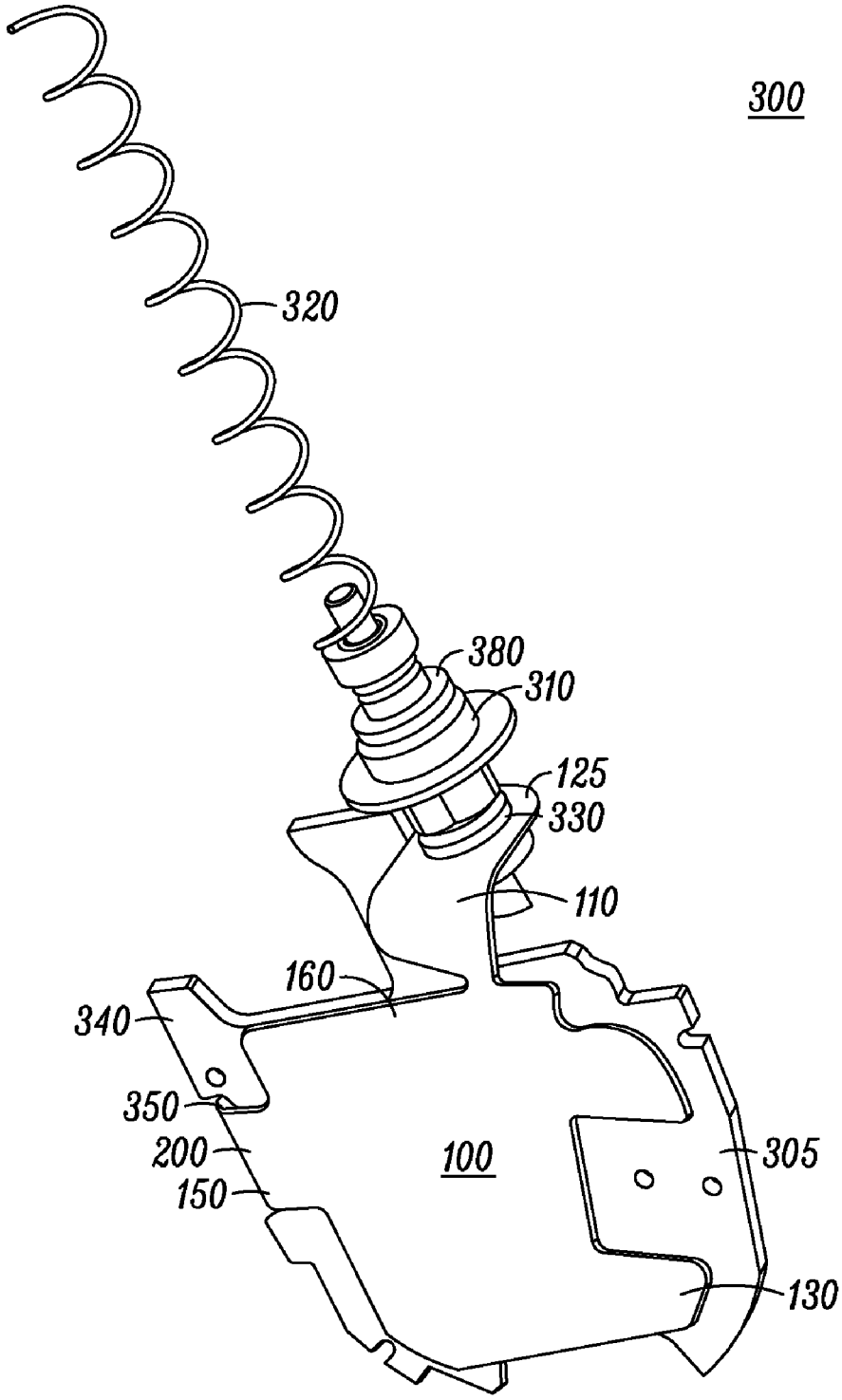
FIG. 3 is a perspective view of an electronic assembly including the foldable metallic patch of FIG. 2 when folded around a circuit board according to embodiments of the present disclosure.

Referring to FIG. 3 there is illustrated a perspective view of an electronic assembly 300, comprising the foldable metallic patch 100 when folded around a circuit board 305. The foldable metallic patch 100 is folded around a circuit board 305 such that the circuit board 305 is sandwiched between the opposite facing portions 130, 140. There is an antenna feed point 310 to which a helical monopole antenna 320 is releasebly coupled by screw or bayonet cap connectors 380 as will be apparent to a person skilled in the art. An antenna counterpoise is formed by the foldable metallic patch 100 and the counterpoise is coupled to the antenna feed point 310 by a connector assembly 330 engaging the aperture 120 and gripping the rim 125.

As shown, the connecting arm is bent approximately 90 degrees in order for the connector assembly 330 to engage the aperture 120 and allow the connecting arm 110 to provide the coupling of the foldable metallic patch 100 to the antenna feed point 310. Furthermore, in an edge 340 of the circuit board 305 there is a slot 350 and the bridging portion 150 is disposed in the slot 350. Thus, the arrangement of the slot 350 and the edge 340 assist in protecting the bridging portion 150 from abrasive wear once the electronic assembly 300 is located in a housing. As will be apparent to a person skilled in the art, the folding of the foldable metallic patch 100 can be performed with the assistance of a custom made jig or by simply using the circuit board 305 as a jig. Once the foldable metallic patch 100 is folded, and sandwiching a circuit board 305, an adhesive or tape may be used to retain the foldable metallic patch over the circuit board 305. However, it is also possible that the engagement of the bridging portion 150 in the slot 350 may be sufficient to retain the foldable metallic patch over the circuit board 305.

Once the foldable metallic patch 100 is folded around a circuit board 305, all edges of both the opposite facing portions 130, 140 do not extend past edges of the circuit board 305 and the electrical insulating material 160 acts as a barrier to limit the possibility of the foldable metallic patch 100 shorting circuit components on the circuit board 305 or components that may be located near the electronic assembly 300.

Figure 4:
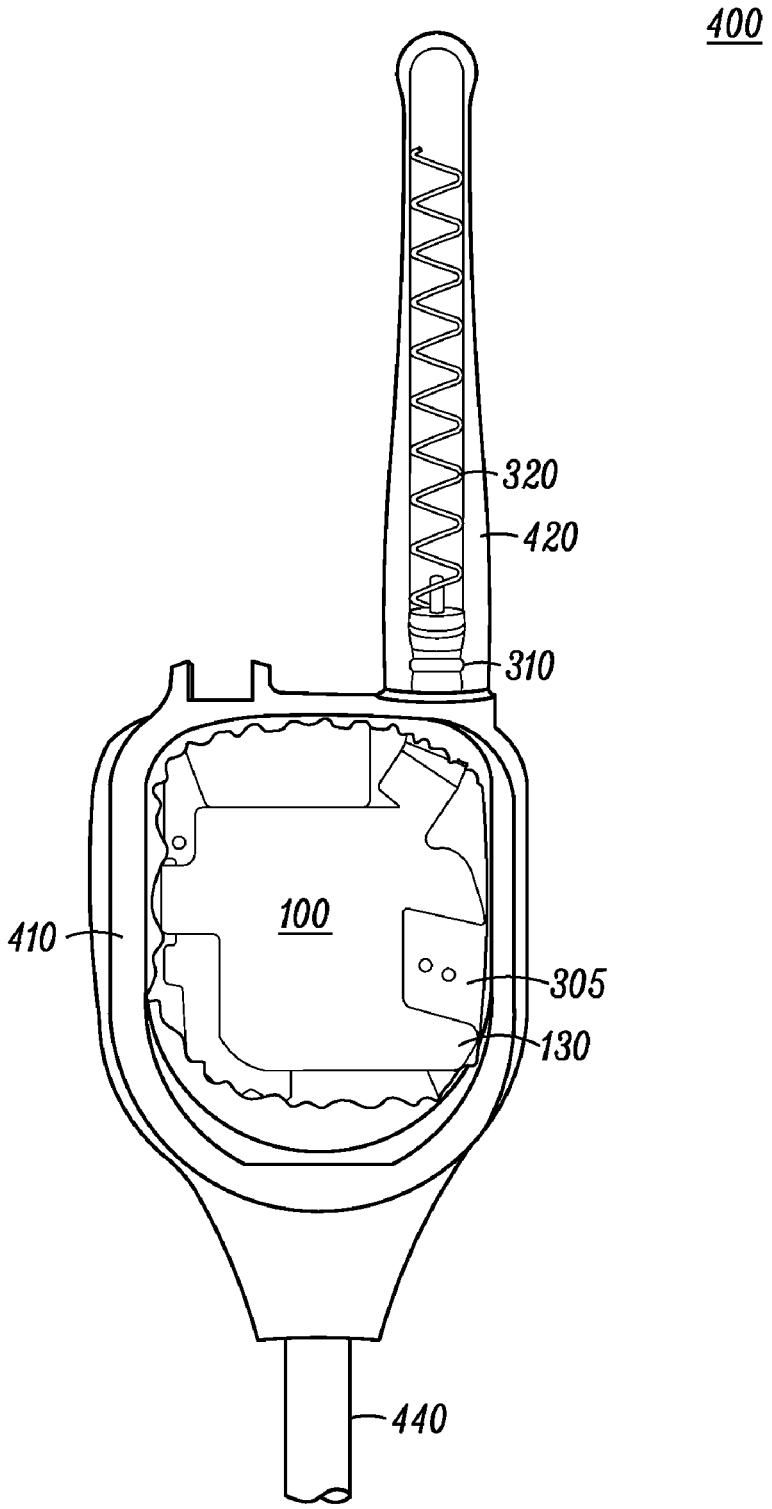
FIG. 4 is a perspective view of an electronic device including the electronic assembly of FIG. 3 according to embodiments of the present disclosure.

Referring to FIG. 4, there is illustrated a perspective view of an electronic device 400 including the electronic assembly 300. The electronic device 400 has a housing 410 partially enclosing the antenna feed point 310 and enclosing the foldable metallic patch 100 that is folded around the circuit board 305. The antenna 320 is an external antenna that is mounted to, and extends out of, the housing and is typically enclosed by a rubber or plastic sheath 420, and coupled to circuitry on the circuit board 305 are conductors bundled in a cable 440. In this embodiment, the electronic device 400 is a Public Safety Microphone that is operatively coupleable by the cable 440 to a two-way radio typically mounted on a belt of a user. When the Public Safety Microphone is operatively coupled to the two-way radio, an antenna of the two way radio is inoperative and radio frequency signals are communicated to and from the antenna 320 along shielded conductor bundled in the cable 440.

Advantageously, the present invention provides a simple and relatively inexpensive counterpoise. Since the circuit board 305 (the main or only circuit board) is sandwiched between the opposite facing portions 130, 140 the counterpoise surrounds the circuit board 305 and thus the radiation pattern of the antenna is not substantially attenuated or distorted by the components of the electronic device 400 that are mounted on the circuit board 305.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any elements that may cause any benefit, advantage, or solution to occur or become more pronounced are not to be construed as critical, required, or essential features or elements of any or all of the claims. The invention is defined solely by the appended claims including any amendments made during the pendency of this application and all equivalents of those claims.

We claim:

1. An electronic assembly comprising:

an antenna feed point;

an antenna coupled to the antenna feed point and extending in a first direction;

at least one circuit board; and an antenna counterpoise also coupled to the feed point and extending in a second direction opposite the first direction, the counterpoise comprising a foldable metallic patch that is folded around the at least one circuit board such that the circuit board is sandwiched between opposite facing planar portions of the foldable metallic patch;

wherein the opposite facing portions of the foldable metallic patch are linked by a bridging portion; and wherein an edge of the circuit board has a slot therein, and wherein the bridging portion extends through the slot.

2. The electronic assembly as claimed in claim 1, wherein the foldable metallic patch is at least partially covered with an electrical insulating material.

3. The electronic assembly as claimed in claim 1, wherein there is a bend in the bridging portion.

4. The electronic assembly as claimed in claim 3, wherein the bend is approximately 180 degrees.

5. The electronic assembly as claimed in claim 1, wherein at least a portion of the bridging portion is covered in an electrical insulating material.

6. The electronic assembly as claimed in claim 1, wherein the bridging portion is positioned at a first edge of the circuit board different from a second edge of the circuit board that is closest to the antenna.

7. An electronic assembly comprising:

an antenna feed point;

an antenna coupled to the antenna feed point and extending in a first direction;

at least one circuit board; and an antenna counterpoise also coupled to the feed point and extending in a second direction opposite the first direction, the counterpoise comprising a foldable metallic patch that is folded around the at least one circuit board such that the circuit board is sandwiched between opposite facing planar portions of the foldable metallic patch;

wherein the foldable metallic patch comprises a foldable connecting arm having an aperture for providing the coupling to the feed point.

8. An electronic assembly comprising:

an antenna feed point;

an antenna coupled to the antenna feed point and extending in a first direction;

at least one circuit board; and an antenna counterpoise also coupled to the feed point and extending in a second direction opposite the first direction, the counterpoise comprising a foldable metallic patch that is folded around the at least one circuit board such that the circuit board is sandwiched between opposite facing planar portions of the foldable metallic patch;

wherein all edges of both the opposite facing planar portions do not extend past edges of the circuit board.

9. An electronic device comprising:

a housing;

an antenna feed point at least partially enclosed in the housing;

an external antenna coupled to the feed point and extending outside of the housing in a first direction;

at least one circuit board enclosed in the housing; and an antenna counterpoise also coupled to the feed point and extending in a second direction opposite the first direction, the counterpoise being enclosed in the housing and the counterpoise comprising a foldable metallic patch that is folded around the at least one circuit board such that the circuit board is sandwiched between opposite facing planar portions of the foldable metallic patch.

10. The electronic device as claimed in claim 9, wherein the foldable metallic patch is covered with an electrical insulating material.

11. The electronic device as claimed in claim 9, wherein the opposite facing planar portions of the foldable metallic patch are linked by a bridging portion.

12. The electronic device as claimed in claim 11, wherein an edge of the circuit board has a slot therein, and wherein the bridging portion extends through the slot.

13. The electronic device as claimed in claim 11, wherein there is a bend in the bridging portion of approximately 180 degrees.

14. The electronic device as claimed in claim 11, wherein the bridging portion is positioned at a first edge of the circuit board different from a second edge of the circuit board that is closest to the antenna.

15. The electronic device as claimed in claim 9, wherein the foldable metallic patch comprises a foldable connecting arm having an aperture for providing the coupling to the feed point.

16. The electronic device as claimed in claim 9, wherein all edges of both the opposite facing planar portions do not extend past edges of the circuit board.

17. The electronic device as claimed in claim 9, wherein the electronic device is a Public Safety Microphone operatively coupleable to a two-way radio.

18. The electronic device as claimed in claim 11, wherein at least a portion of the bridging portion is covered in an electrical insulating material.

* * * * *